US006170762B1

(12) United States Patent
Sumida et al.

(10) Patent No.: US 6,170,762 B1
(45) Date of Patent: Jan. 9, 2001

(54) CYLINDER INJECTION TYPE FUEL INJECTION VALVE

(75) Inventors: Mamoru Sumida; Norihisa Fukutomi, both of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/414,423

(22) Filed: Oct. 7, 1999

(30) Foreign Application Priority Data

May 7, 1999 (JP) ..... 11-126656

(51) Int. Cl.[7] ..... B05B 1/34
(52) U.S. Cl. ..... 239/463; 239/533.12; 239/585.4
(58) Field of Search ..... 239/463, 464, 239/473, 533.9, 533.12, 585.3, 585.4, 585.5

(56) References Cited

U.S. PATENT DOCUMENTS 5,108,037 * 4/1992 Okamoto et al. ..... 239/473
5,871,157 2/1999 Fukutomi et al. .
5,954,274 * 9/1999 Sumida et al. ..... 239/533.12
5,967,423 * 10/1999 Sumida et al. ..... 239/533.12
5,996,912 * 12/1999 Ren et al. ..... 239/585.5

FOREIGN PATENT DOCUMENTS 10-47208 2/1998 (JP) .

* cited by examiner

*Primary Examiner*—Lesley D. Morris
(74) *Attorney, Agent, or Firm*—Sughrue, Mion, Zinn, Macpeak & Seas, PLLC

(57) ABSTRACT

A valve-closure member has an outer straight portion or an outer cylindrical portion confronted respective groove outlets of a swirler at a length of not less than ⅓ of the groove depth of the grooves when the valve is fully opened, or at a length of not less than 1/10 of the groove depth when the valve is totally closed.

6 Claims, 8 Drawing Sheets

(a)

(b)

CYLINDER INJECTION TYPE FUEL INJECTION VALVE

BACKGROUND OF THE INVENTION

1. Field of the Invention

The present invention relates to a cylinder injection type fuel injection valve to be used in a cylinder injection type internal combustion engine (four-cycle engine or two-cycle engine) that gives swirling energy to fuel streams by a swirling device and injects the fuel from a fuel injection nozzle directly into a combustion chamber, in particular a fuel injection valve appropriate to fuel injection with a small angle of spray from the injection nozzle.

2. Discussion of Background

Heretofore, there has been an internal combustion engine wherein premixed combustion is carried out at a high output and stratified combustion is carried out at a low output, and that the premixed combustion and the stratified combustion are switched in accordance with the operational conditions of the engine as disclosed in WO96-36808. Such an internal combustion engine can optimize the shape of a combustion chamber, an air streaming method, the position of a fuel injection valve, characteristics of the spray, the position of an ignition plug and other factors in order to meet incompatible requirements of improvement in output and improvement in mileage.

However, when such an internal combustion engine is used for, e.g., an automobile, the optimization of these factors can not be realized in all cases since there are various limitations based on the system or the specifications of the engine, parts for induction and exhaust systems, the layout of parts for a fuel system and the appearance of the vehicle.

Unless there is adopted a method wherein improvement in output is compatible with improvement in mileage with existing techniques and facilities utilized, the production cost is raised, making the business unprofitable.

Under the circumstances, one of the most important technical issues is that premixed combustion and stratified combustion are compatible. In order to make the two combustion concepts compatible, the shape of a combustion chamber, an air streaming method, the position of a fuel injection valve, the characteristics of spray, the position of an ignition plug become relevant as stated earlier. It is fundamental that homogenous mixture is created by diffused spray in premixed combustion and that converged spray is collected in the vicinity of an ignition plug in stratified combustion.

Various kinds of investigations have been conducted about the research on new peripheral parts for a fuel system, system concepts for a fuel system or a combustion system, control methods and other issues in order to realize the technical issue stated earlier while minimizing the increase in cost with existing techniques, facilities and parts utilized.

In order to explain the basic structure of such a cylinder injection type fuel injection valve, the fuel injection valve that has been disclosed in JP-A-1047208 will be explained as a conventional fuel injection valve.

In FIG. 6 is shown a cross-sectional side view of the entire structure of the cylinder injection type fuel injection valve 1 disclosed in the publication. The cylinder injection type fuel injection valve 1 comprises a main housing 2, and a valve unit 3 fixed to an end of the main housing 2 by, e.g., caulking and covered by a holder 35. The main housing 2 has the other end connected to a fuel supply pipe 4, from which fuel is supplied, at a high pressure, into the cylinder injection type fuel injection valve 1 through a fuel filter 57. The cylinder injection type fuel injection valve 1 has a leading portion inserted into an inserting port 6 of a cylinder head 5 in an internal combustion engine and sealed by, e.g., a wave washer 60 or a similar member.

The valve unit 3 includes a valve body 9 formed in a stepped hollow cylindrical shape so as to have a small diameter of cylindrical portion 7 and a large diameter of cylindrical portion 8, a valve seat 11 fixed to a leading edge of a central hole in the valve body 9 and having a fuel injection nozzle 10 formed therein, a needle valve 12 as a valve-closure member to be moved away from and toward the valve seat 11 by a solenoid unit 50 stated later on to open and close the fuel injection nozzle 10, a swirler 13 for guiding the needle valve 12 in an axial direction and for radially and inwardly giving swirling movement to the fuel before the fuel enters the injection nozzle 10. The valve body 9 of the valve unit 3 and the main housing 2 provide the cylinder injection type fuel injection valve 1 with a total housing.

The main housing 2 includes a first housing 30 having a flange 30*a* for mounting the cylinder injection type fuel injection valve 1 to the cylinder head 5, and a second housing 40 with the solenoid unit 50 mounted thereon. The solenoid unit 50 includes a bobbin 52 with a coil 51 wound thereon and a core 53 provided at an inner peripheral portion of the bobbin 52. The coil 51 is connected to a terminal 56. The core 53 is formed in a hollow cylinder shape to provide a fuel passage therein. The core 53 has a spring 55 provided between a sleeve 54 and the needle valve 12 in the hollow portion thereof.

The needle valve 12 has an end remote from the valve seat 11 provided with a movable armature 31 so as to confront a leading edge of the core 53. The needle valve 12 has an intermediate portion thereof provided with a guide 12*a* for slidably guiding the needle valve 12 along an inner peripheral surface of the valve unit 9, and a needle flange 12*b* in contact with a spacer 32 provided in the first housing 30.

In FIG. 7 is shown a front view of the swirler 13 as viewed from the side of the valve seat 11. In FIGS. 8 and 9 are shown an enlarged cross-sectional side view and an exploded perspective view of the valve seat of the valve unit 3 and its surroundings. As shown in these Figures, the swirler 13 of the valve unit 3 is a hollow member formed in a substantially cylindrical shape, which has a central hole 15 formed therein so as to surround the needle valve 12 as the valve-closure member at the center and to slidably support the needle valve in the axial direction. The swirler includes a first end surface 16 and a second end surface 17. When the swirler is assembled into the valve unit 3, the first end surface contacts the valve seat 12 and the second end surface is located on the side remote from the valve seat 11. The swirler has an outer circumferential surface 19 extended between both end surfaces so as to partly contact the inner peripheral surface 18 of the valve body 9 as a part of the hollow total housing.

The second end surface 17 of the swirler 13 has peripheral portions contacted with and supported by a shoulder 20 provided on the inner peripheral surface 18 of the valve body 9. The second end surface has grooved passages 21 radially formed thereon to flow the fuel from an inner periphery to an outer periphery of the second end surface.

The outer circumferential surface 19 of the swirler 13 has a plurality of flat surfaces formed thereon so as to be separated one another at equal intervals in the circumferential direction and to extend in the axial direction. Thus, a plurality of outer peripheral surface portions 19*a* that contact the inner peripheral surface 18 of the valve body 9 to define the position of the swirler 13 to the valve body 9, and flow passage portions 19*b* that are flat surfaces provided between adjacent outer peripheral surface portions to form axial passages 22 for the fuel between the inner peripheral surface 18 and the flat surfaces are provided on the outer circumferential surface 19.

On the first end surface 16 as an axial end surface of the swirler 13 confronting the valve seat 11, an inner annular groove 24 is provided at an inner periphery close to the central hole 15 of the first end surface 16 so as to have a certain width, and swirling grooves 25 are provided so that one end of each of the swirling grooves is connected to a flow passage portion 19*b* on the outer circumferential surface 19 and that each of the swirling grooves extends in an almost radially inward direction to have the other end connected to the inner annular grove 24 in a tangential direction.

Next, the operation of the cylinder injection type fuel injection valve will be explained. When the coil 51 of the solenoid unit 50 is energized through the terminal 56 from the external, magnetic flux is generated in the magnetic circuit formed by the movable armature 31, the core 53 and the main housing 2 to attract the movable armature 31 toward the core 53 against the elastic force of the spring 55. As a result, the needle valve 12, which is integral with the movable armature 31, is moved in the right direction in FIG. 6 by a certain stroke until the needle flange 12*b* contacts the spacer 32. The needle valve 12 is guided and supported on the inner peripheral surface of the valve body 9 by the guide 12*a*.

When the leading edge of the needle valve 12 gets away from the valve seat 11 to provide a gap, the fuel, which is introduced from the fuel supply pipe 4 at a high pressure, flows into the axial passages 22 on the outer circumferential surface 19 from the passage between the valve body 9 and the needle valve 12 through the grooved passages 21 in the second end surface 17 of the swirler 13. Then, the fuel flows into the swirling grooves 25 in the first end surface 16 of the swirler 13 and is directed to a radially inward direction. After that, the fuel flows tangentially into the inner annular groove 24 in the first end surface 16, enters the injection nozzle 10 in the valve seat 11 as swirling streams, and is sprayed through the outlet at the leading end of the nozzle. In FIG. 9, reference numeral 11*a* designates a tapered surface provided on the valve seat, reference numeral 12*c* designates a rounded surface of the valve-closure member, and an arrow C designates the flow direction of the fuel.

The present invention provides a fuel injection valve appropriate to an engine wherein the combustion concept is optimized when the fuel injection valve has a relatively small angle of spray (not greater than 50°), or when the spray density is symmetrical with respect to the spray axis though there is little influence of a degree of hollow cone (a degree of solidity) of the spray. In order to decrease the angle of spray in a conventional swirler 13 shown in FIG. 10(*a*) as an enlarged view of the essential portion, a change in design, such as an increase in the cross-sectional area of the swirling grooves 25 as shown in FIG. 10(*b*), is required. However, when the swirling grooves have a width $W_1$ enlarged, adjoining swirling grooves interfere each other in swirlers with the grooves formed at the number of, e.g., four of six, an effective length $L_1$ thereof is shortened to $L_2$. Thus, the fuel streams in the respective swirling grooves 25 flow into the inner annular groove 24 and join together without being stabilized, creating a problem in that it is difficult to equalize the swirling streams.

In addition, the inner annular groove has an effective annular diameter extended from $D_1$ to $D_2$ to increase the amount of non-swirling fuel at an initial spraying stage, having adverse effect on the combustion in some cases. In other words, a portion of the fuel (the volume from a location upstream the swirling grooves of the swirler to a location upstream the valve seat=non-swirling volume, the portion indicated by "B" in FIG. 11) is sprayed without being subjected to swirling movement at an initial spray stage, and the particle size in that portion is greater since almost no swirling movement is given to that portion. When the groove depth d of the swirling grooves is relatively smaller than the width of the swirling grooves, it is presumed that almost no swirling movement is given because of the provision of such a flow pattern to extrude almost the entire amount of the non-swirling volume at the initial spray stage.

The provision of the grooves at a number smaller than four is not appropriate since the provision of the grooves at such a number can not equalize the swirling streams inherently.

Next, a case wherein the groove depth is enlarged to increase the cross-sectional area of each of the grooves irrespectively of the width of the swirling grooves will be considered.

Since the valve-closure member normally has an outer surface portion confronting the outlets of the grooves formed in an almost rounded shape or a tapered shape even in a totally closed state as shown in FIG. 11, the outer surface portion provides an aid to give axial components to the swirling streams so as to helically flow out the streams. For example, the effect offered by the outer surface portion is great when the angle of spray is from about 50° to about 80°. When the angle of spray is great, the helical angle (the angle from a plane perpendicular to the axis of the valve-closure member) of helical streams is small, which means that there are an enough time and enough room to equalize the swirling components provided in a number corresponding to the number of the grooves.

On the other hand, when the value required for the angle of spray is small, it is required to make design so as to decrease swirling forces. When the outer surface portions of the valve-closure member confronting the outlet of the grooves is formed in a rounded shape or tapered shape since the helical angle is great, the fuel streams are flowed out without having the swirling components equalized. As a result, the conical shape of the spray is not uniform though the angle of spray is small, or the spray is formed in a polygonal shape to correspond the number of the grooves as shown in FIG. 12(*a*). In FIG. 12(*b*) is shown the ideally shape of the spray.

If the spray is formed in such a way, it is required not only to define the position of the swirler in the circumferential direction in the production of a fuel injection valve but also to accurately define the orientation (the position) of the swirler in the circumferential direction during mounting the fuel injection valve to an engine. Otherwise, variations in the combustion state of the respective cylinders or variations in the combustion state of respective engines are caused, which is extremely inconvenient.

SUMMARY OF THE INVENTION

The present invention is provided on finding that as the results of many experiments on various shapes of swirlers carried out to seek a solution to the problems, the outer surface portion of the valve-closure member confronting the groove outlets can have a fraction thereof formed in a cylindrical shape by a ratio of not less than a certain value to equalize the conical shape of the spray since the fuel can be flowed downstream after the swirling components in the number of the grooves at the annular groove have been equalized to some extent.

According to a first aspect of the present invention, there is provided a cylinder injection type fuel injection valve which comprises a valve body formed in a hollow shape; a valve seat provided in an end of the valve body and having an injection nozzle formed therein; a valve-closure member provided in the valve body so as to be movable therein and to move away from and toward the valve seat for opening and closing the injection nozzle; and a swirler provided around the valve-closure member to slidably support the valve-closure member and give a swirling force to fuel to be sprayed through the injection nozzle, the swirler having grooves formed therein, and the respective grooves having a groove depth and groove outlets; wherein the valve-closure member has an outer straight portion or an outer cylindrical portion confronted each of the groove outlets at a length of not less than ⅓ of the groove depth when the valve is totally closed.

According to a second aspect of the present invention, there is provide a cylinder injection type fuel injection valve which comprises a valve body formed in a hollow shape; a valve seat provided in an end of the valve body and having an injection nozzle formed therein; a valve-closure member provided in the valve body so as to be movable therein and to move away from and toward the valve seat for opening and closing the injection nozzle; and a swirler provided around the valve-closure member to slidably support the valve-closure member and give a swirling force to fuel to be sprayed through the injection nozzle, the swirler having grooves formed therein, and the respective grooves having a groove depth and groove outlets; wherein the valve-closure member has an outer straight portion or an outer cylindrical portion confronted the respective groove outlets at a length of not less than 1/10 of the groove depth when the valve is fully opened.

According to a third aspect of the present invention, the injection valve in the first or second aspect is applied to a spray requirement wherein the injection nozzle provides an angle of spray of not greater than 50°.

According to a fourth aspect of the present invention, the valve-closure member has a portion thereof from the outer straight portion to a valve seat portion formed in a rounded surface or a spherical surface so as to tangentially merge in the outer straight portion in the injection nozzle according to the first or second aspect.

In accordance with the first or second aspect, the injection valve can offer an advantage in that a spraying cone from the injection nozzle is equalized even in a small angle of spray.

In accordance with the third aspect, the injection valve can fully perform its effectiveness.

In accordance with the fourth aspect, a further advantageous effect can be offered by equalization of spraying since a portion of the spherical portion near the straight portion is almost approximate to the straight portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, herein.

DETAILED DESCRIPTION OF THE PREFERRED EMBODIMENTS

Embodiment 1

Figure 1:
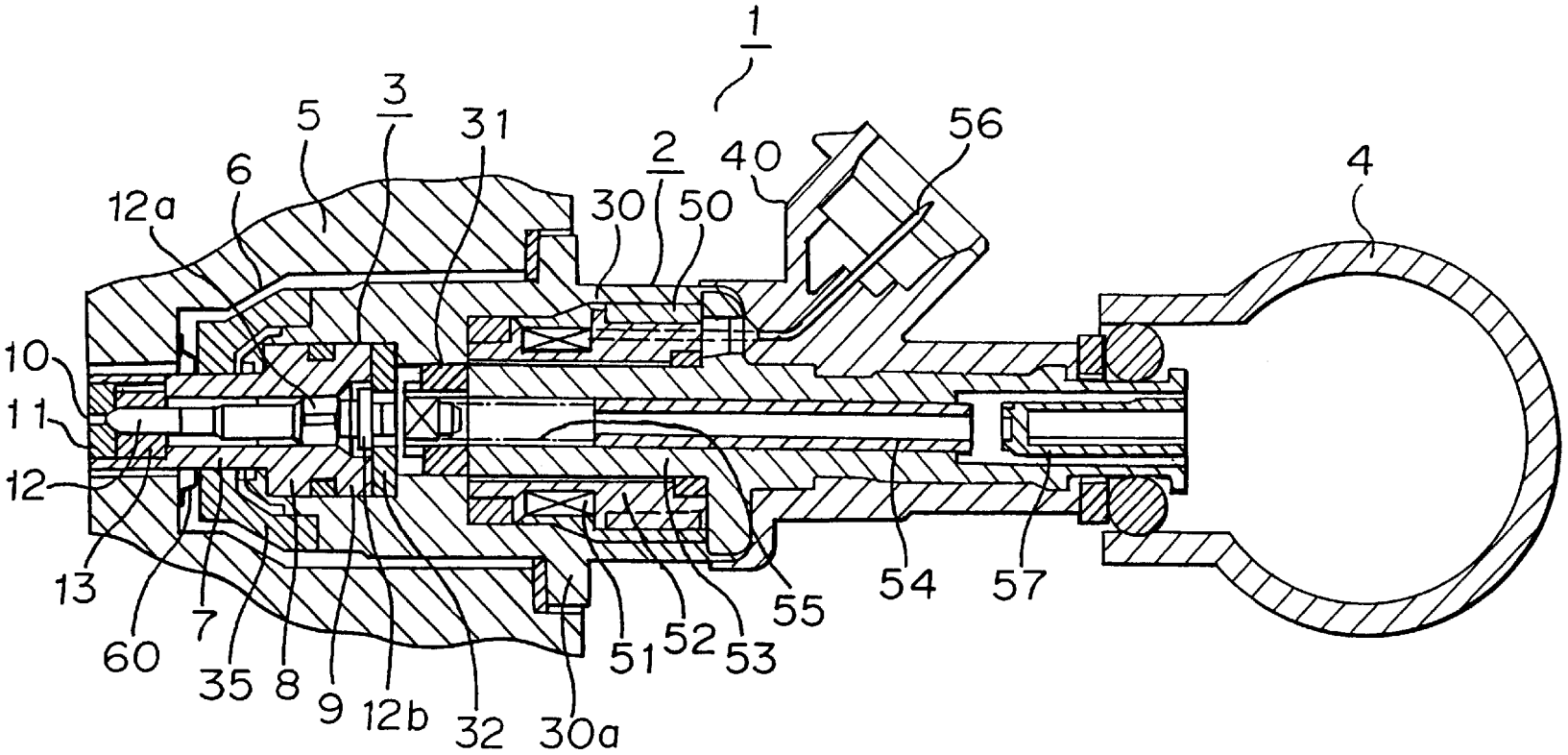
FIG. 1 is a cross-sectional side view of the entire structure of the cylinder injection type fuel injection valve according to a first embodiment of the present invention.
Figure 2:
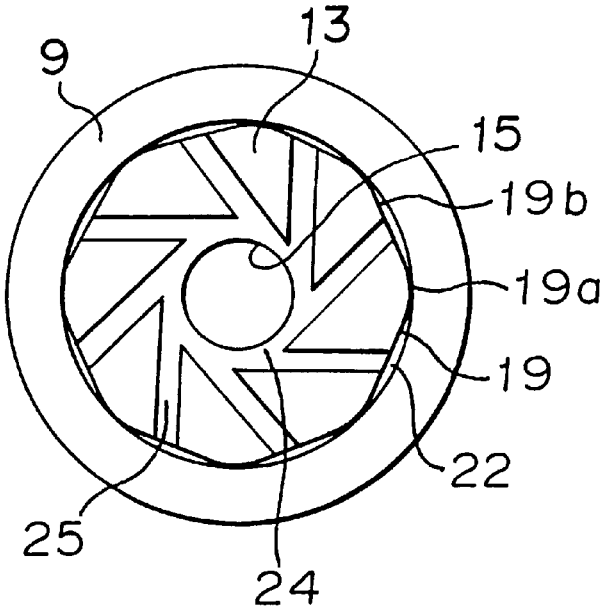
FIG. 2 is an enlarged end view of the leading end of a valve unit applicable to the valve of FIG. 1 as viewed from a valve seat side of a swirler of the valve unit.
Figure 3:
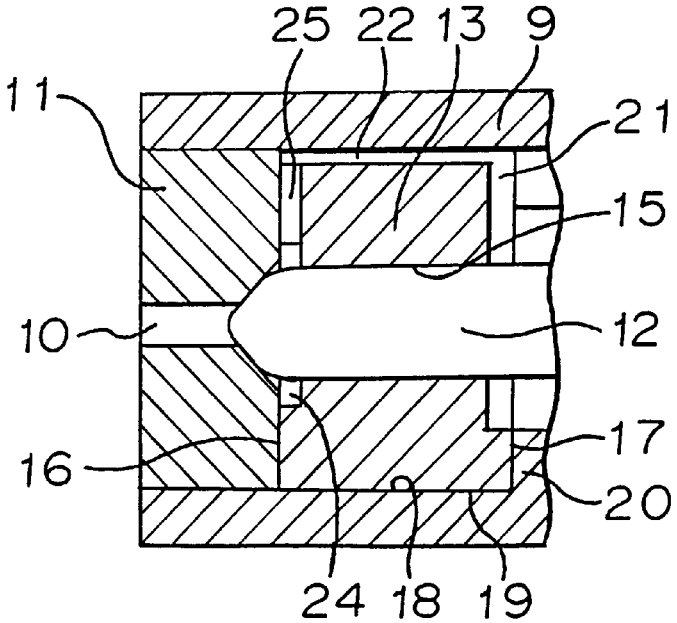
FIG. 3 is an enlarged cross-sectional view of a valve seat of the valve and its surroundings.

In FIG. 1 is shown a cross-sectional side view of the entire structure of the cylinder injection type fuel injection valve according to a first embodiment of the present invention. In FIG. 2 is shown an enlarged view of the leading edge of a valve unit of the injection valve of FIG. 1. In FIG. 3 is shown a cross-sectional view of the valve seat of the valve unit and its surroundings.

Since the basic constituent elements of the fuel injection valve shown in FIGS. 1–3 are the substantially same as those of the conventional valve, identical or corresponding parts are indicated by the same reference numerals.

The cylinder injection type fuel injection valve 1 comprises a main housing 2, and a valve unit 3 fixed to an end of the main housing 2 by, e.g., caulking and covered by a holder 35. The main housing 2 has the other end connected to a fuel supply pipe 4, from which fuel is supplied, at a high pressure, into the cylinder injection type fuel injection valve 1 through a fuel filter 57. The cylinder injection type fuel injection valve 1 has a leading portion inserted into an inserting port 6 of a cylinder head 5 in an internal combustion engine and sealed by, e.g., a wave washer 60 or a similar member.

The valve unit 3 includes a valve body 9 formed in a stepped hollow cylindrical shape so as to have a small diameter of cylindrical portion 7 and a large diameter of cylindrical portion 8, a valve seat 11 fixed to a leading edge of a central hole in the valve body 9 and having a fuel injection nozzle 10 formed therein, a needle valve 12 as a valve-closure member to be moved away from and toward the valve seat 11 by a solenoid unit 50 stated later on to open and close the fuel injection nozzle 10, a swirler 13 for guiding the needle valve 12 in an axial direction and for radially and inwardly giving swirling movement to the fuel before the fuel enters the injection nozzle 10. The valve body 9 of the valve unit 3 and the main housing 2 provide the cylinder injection type fuel injection valve 1 with a total housing.

The main housing 2 includes a first housing 30 having a flange 30*a* for mounting the cylinder injection type fuel injection valve 1 to the cylinder head 5, and a second housing 40 with the solenoid unit 50 mounted thereon. The solenoid unit 50 includes a bobbin 52 with a coil 51 wound thereon and a core 53 provided at an inner peripheral portion of the bobbin 52. The coil 51 is connected to a terminal 56. The core 53 is formed in a hollow cylinder shape to provide a fuel passage therein. The core 53 has a spring 55 provided between a sleeve 54 and the needle valve 12 in the hollow portion thereof.

The needle valve 12 has an end remote from the valve seat 11 provided with a movable armature 31 so as to confront a leading edge of the core 53. The needle valve 12 has an intermediate portion thereof provided with a guide 12*a* for slidably guiding the needle valve 12 along an inner peripheral surface of the valve unit 9, and a needle flange 12*b* in contact with a spacer 32 provided in the first housing 30.

In FIG. 2 is shown a front view of the swirler 13 as viewed from the side of the valve seat 11. In FIG. 3 is shown an enlarged cross-sectional side view of the valve seat of the valve unit 3 and its surroundings. As shown in these Figures, the swirler 13 of the valve unit 3 is a hollow member formed in a substantially cylindrical shape, which has a central hole 15 formed therein so as to surround the needle valve 12 as the valve-closure member at the center and to slidably support the needle valve in the axial direction. The swirler includes a first end surface 16 and a second end surface 17. When the swirler is assembled into the valve unit 3, the first end surface contacts the valve seat 11 and the second end surface is located on the side remote from the valve seat 11. The swirler has an outer circumferential surface 19 extended between both end surfaces so as to partly contact the inner peripheral surface 18 of the valve body 9 as a part of the hollow total housing.

The second end surface 17 of the swirler 13 has peripheral portions contacted with and supported by a shoulder 20 provided on the inner peripheral surface 18 of the valve body 9. The second end surface has grooved passages 21 radially formed thereon to flow the fuel from an inner periphery to an outer periphery of the second end surface.

The outer circumferential surface 19 of the swirler 13 has a plurality of flat surfaces formed thereon so as to be separated one another at equal intervals in the circumferential direction and to extend in the axial direction. Thus, a plurality of outer peripheral surface portions 19*a* that contact the inner peripheral surface 18 of the valve body 9 to define the position of the swirler 13 to the valve body 9, and flow passage portions 19*b* that are flat surfaces provided between adjacent outer peripheral surface portions to form axial passages 22 for the fuel between the inner peripheral surface 18 and the flat surfaces are provided on the outer circumferential surface 19.

On the first end surface 16 as an axial end surface of the swirler 13 confronting the valve seat 11, an inner annular groove 24 is provided at an inner periphery close to the central hole 15 of the first end surface 16 so as to have a certain width, and swirling grooves 25 are provided so that one end of each of the swirling grooves is connected to a flow passage portion 19*b* on the outer circumferential surface 19 and that each of the swirling grooves extends in an almost radially inward direction to have the other end connected to the inner annular groove 24 in a tangential direction.

Next, the operation of the cylinder injection type fuel injection valve will be explained. When the coil 51 of the solenoid unit 50 is energized through the terminal 56 from the external, magnetic flux is generated in the magnetic circuit formed by the movable armature 31, the core 53 and the main housing 2 to attract the movable armature 31 toward the core 53 against the elastic force of the spring 55. As a result, the needle valve 12, which is integral with the movable armature 31, is moved in the right direction in FIG. 1 by a certain stroke until the needle flange 12*b* contacts the spacer 32. The needle valve 12 is guided and supported on the inner peripheral surface of the valve body 9 by the guide 12*a*.

When the leading edge of the needle valve 12 gets away from the valve seat 11 to provide a gap, the fuel, which is introduced from the fuel supply pipe 4 at a high pressure, flows into the axial passages 22 on the outer circumferential surface 19 from the passage between the valve body 9 and the needle valve 12 through the grooved passages 21 in the second end surface 17 of the swirler 13. Then, the fuel flows into the swirling grooves 25 in the first end surface 16 of the swirler 13 and is directed to a radially inward direction. After that, the fuel flows tangentially into the inner annular groove 24 in the first end surface 16, enters in the injection nozzle 10 in the valve seat 11 as swirling streams, and is sprayed through the outlet at the leading end of the nozzle.

Figure 4:
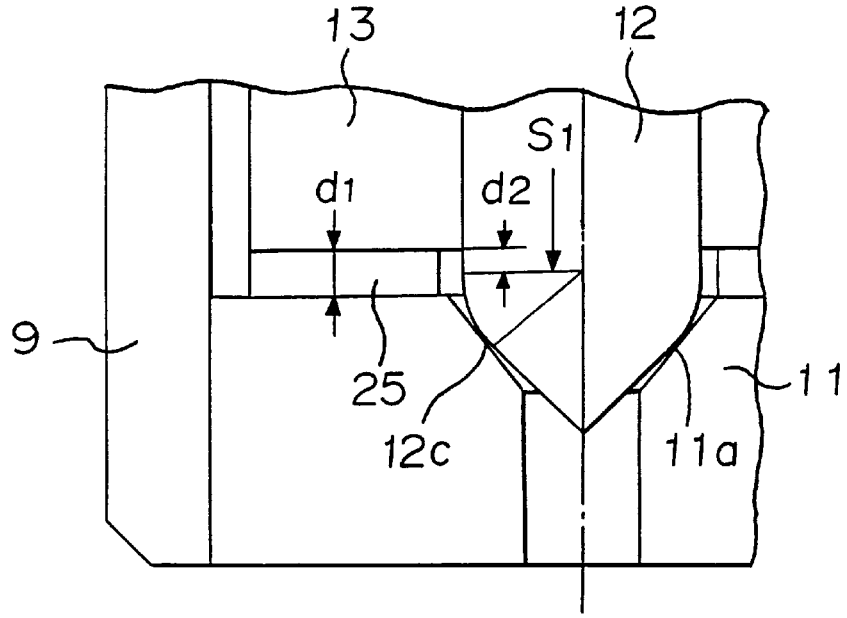
FIG. 4 is an enlarged cross-sectional view of the essential portion of the valve according to the first embodiment.

In the first embodiment, the valve-closure member has an outer straight portion or an outer cylindrical portion $S_1$ confronted the respective groove outlets at a length $d_2$ of not less than ⅓ of the depth $d_1$ ($d_2 \geqq d_1/3$) of the swirling grooves when the valve is totally closed, as shown as an enlarged cross-sectional view in FIG. 4.

In this Figure, reference numeral 11*a* designates a tapered surface provided on the valve seat. Reference numeral 12*c* designates a rounded or spherical surface of the valve-closure member.

When the length of the portion of the outer cylindrical portion confronting the groove outlets is thus specified with the valve totally closed, it was showed that the spray was equalized in a small angle of spray.

Embodiment 2

Figure 5:
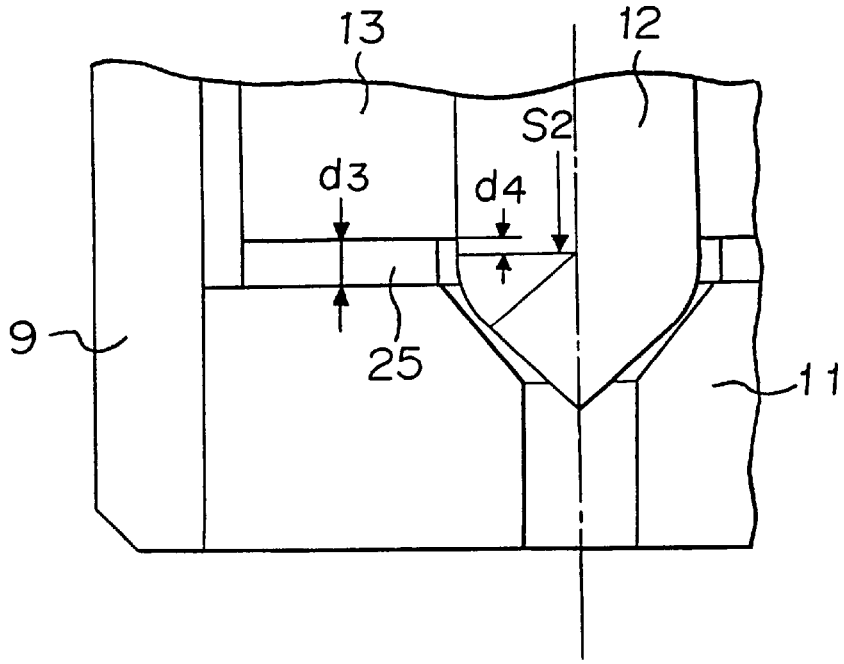
FIG. 5 is an enlarged cross-sectional view of the essential portion of the cylinder injection type fuel injection valve according to a second embodiment of the present invention.
Figure 6:
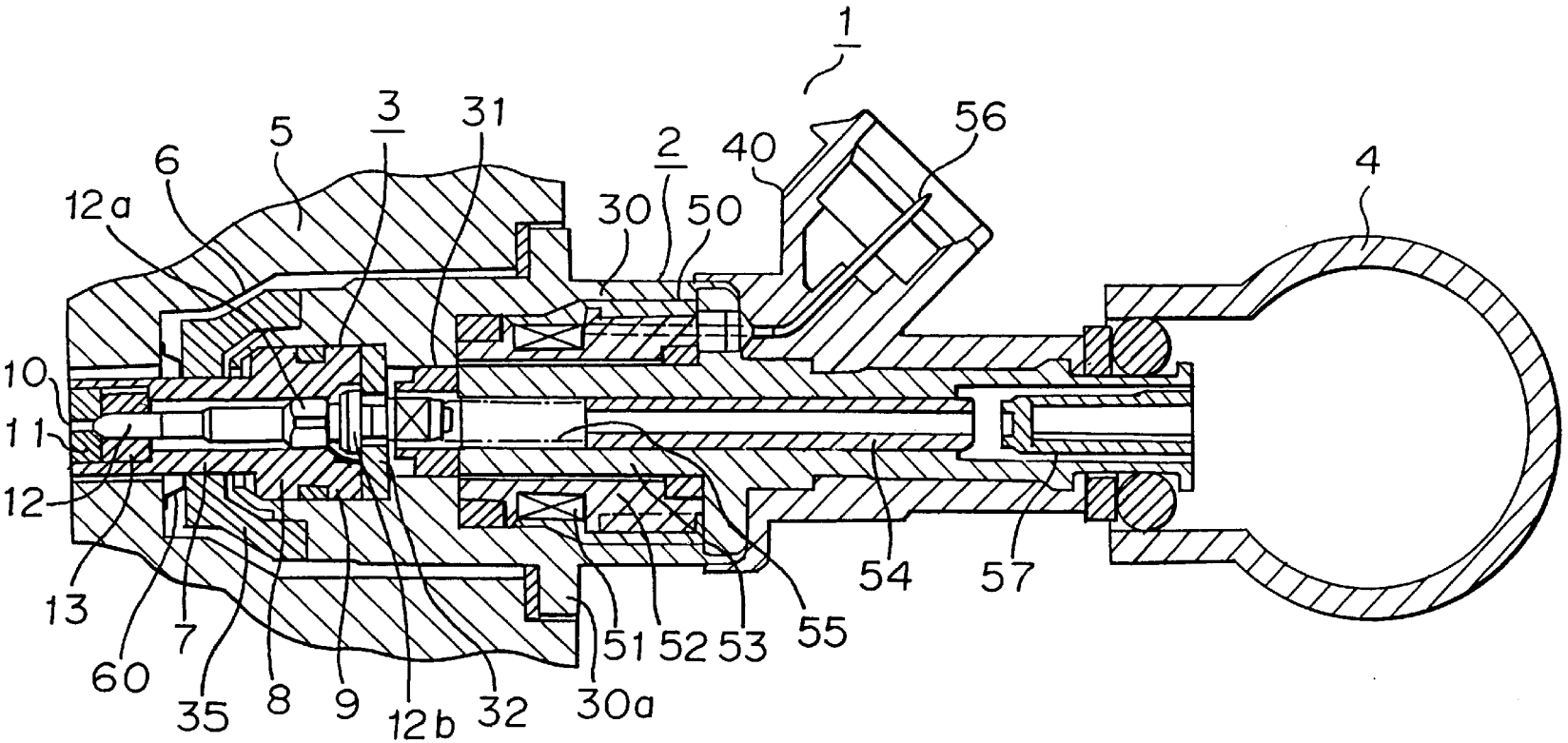
FIG. 6 PRIOR ART
FIG. 6 is a cross-sectional side view of the entire structure of a conventional cylinder injection type fuel injection valve.
Figure 7:
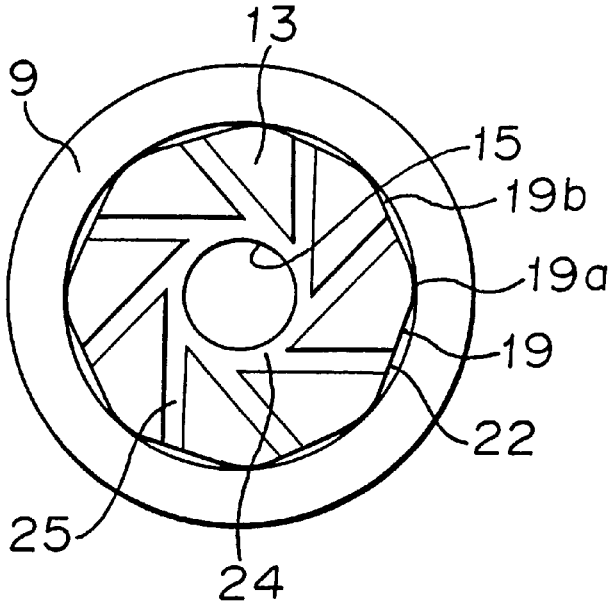
FIG. 7 PRIOR ART
FIG. 7 is an enlarged end view of the leading end of the swirler of FIG. 6 as viewed from a valve seat side thereof.
Figure 8:
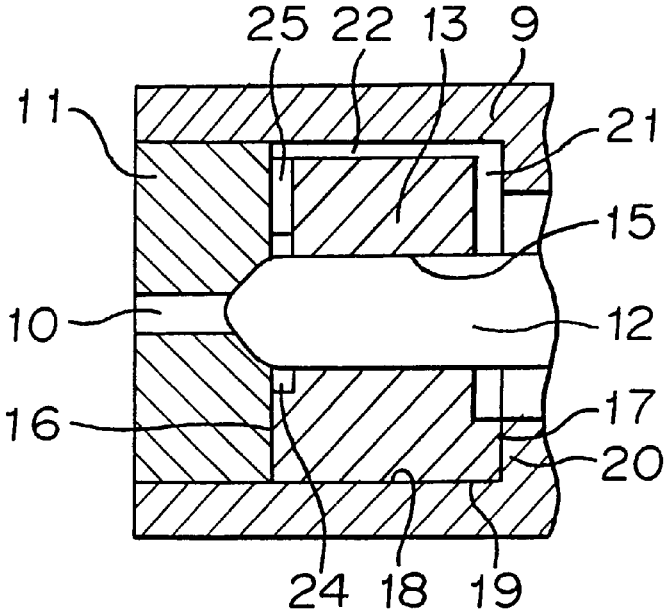
FIG. 8 PRIOR ART
FIG. 8 is an enlarged cross-sectional view of the valve seat of FIG. 6 and its surroundings.
Figure 9:
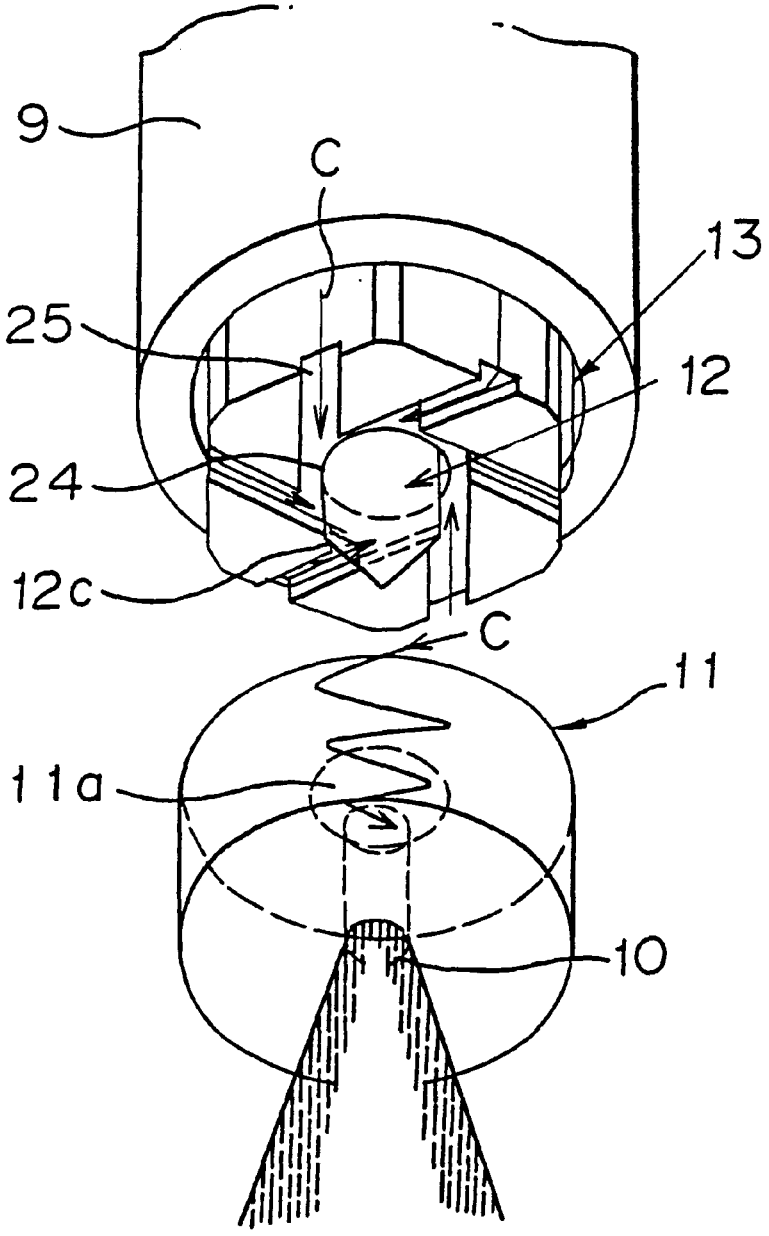
FIG. 9 PRIOR ART
FIG. 9 is an exploded perspective view of the valve unit of the conventional valve as viewed from an obliquely downward position.
Figure 10:
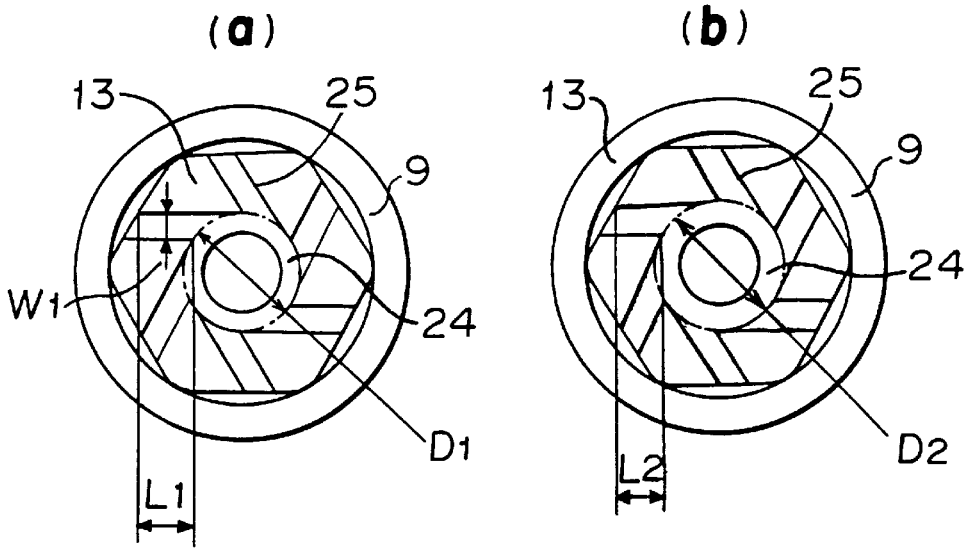
FIG. 10 PRIOR ART
FIGS. 10(*a*) and (*b*) are views to explain the relationship between a groove width and a groove length in different swirlers.
Figure 11:
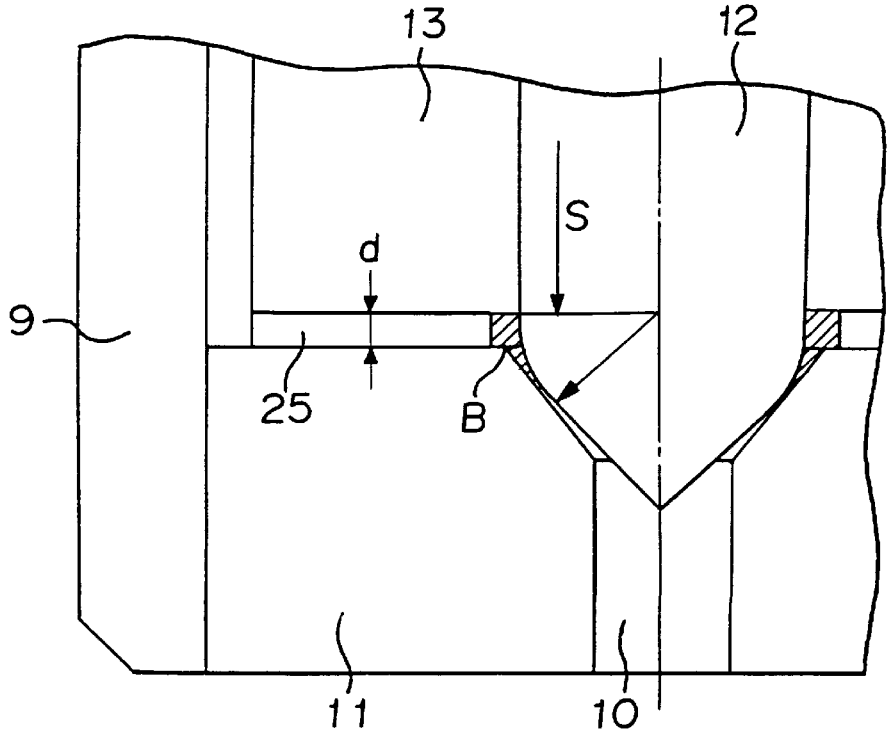
FIG. 11 PRIOR ART
FIG. 11 is a cross-sectional view of the essential portion of the conventional valve.
Figure 12:
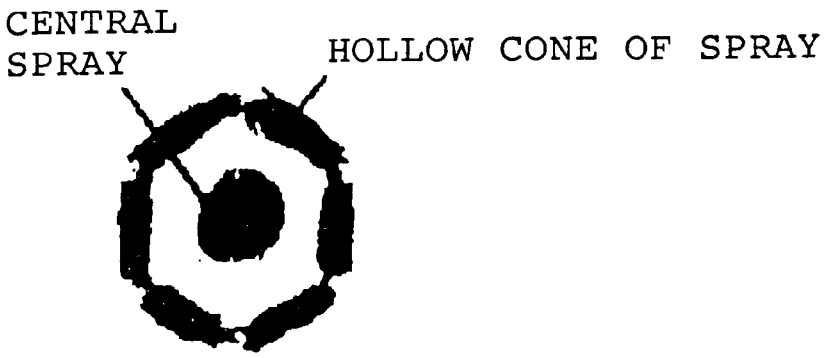
FIG. 12 PRIOR ART
FIGS. 12(*a*) and (*b*) are a view to show the spraying shape of non-swirled fuel in an initial spraying stage in the conventional valve, and a view to show an ideal spraying shape.
Figure 12:
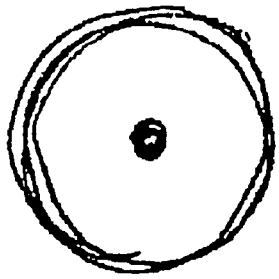
FIG. 12 PRIOR ART

In FIG. 5 is shown an enlarged cross-sectional view of a second embodiment of the present invention. In this embodiment, the valve-closure member has an outer straight portion or an outer cylindrical portion $S_2$ confronted the respective groove outlets at a length $d_4$ of not less than 1/10 of the depth $d_3$ ($d_4 \geqq d_3/10$) of the swirling grooves when the valve is fully opened.

When the length of the portion of the outer cylindrical portion confronting the groove outlets is thus specified with the valve fully opened, it was showed that the spray was equalized in a small angle of spray.

Embodiment 3

When the valve-closure member is a seat portion formed in a spherical shape and tangentially merged with the outer straight portion in the valve unit according to the first and second embodiments as shown, a portion of the seat portion of the valve-closure member close to the outer straight portion is almost approximate to the outer straight portion, allowing a further advantageous effect to be offered.

In the cylinder injection type fuel injection valve according to the present invention, the swirler and the valve seat may be produced independently of the valve body, and the swirler and the valve seat may be assembled to the valve body from the downstream direction of the sprayed streams. The swirler may have the end surface on the upstream side of the sprayed streams contacted the stepped surface of the valve unit. The end surface in contact with the stepped surface may have fuel passages formed therein in a number corresponding to the number of the swirling grooves.

The valve body and the valve seat may be produced in a one-piece construction, and the swirler may be assembled from the upstream side to offer the totally same effect.

The leading edge of the valve body may be formed in a tapered shape or a multi-stepwise tapered shape, instead of a spherical shape, to offer a similar effect.

Obviously, numerous modifications and variations of the present invention are possible in light of the above teachings. It is therefore to be understood that within the scope of the appended claims, the invention may be practiced otherwise than as specifically described herein.

What is claimed is:

1. A cylinder injection type fuel injection valve comprising:

a valve body formed in a hollow shape;

a valve seat provided in an end of the valve body and having an injection nozzle formed therein;

a valve-closure member provided in the valve body so as to be movable therein and to move away from and toward the valve seat for opening and closing the injection nozzle; and a swirler provided around the valve-closure member to slidably support the valve-closure member and give a swirling force to fuel to be sprayed through the injection nozzle, the swirler having grooves formed therein, and the respective grooves having a groove depth and groove outlets;

wherein the valve-closure member has an outer straight portion or an outer cylindrical portion confronting the respective groove outlets at a length of not less than ⅓ of the groove depth when the valve is totally closed.

2. The injection valve according to claim 1, which is applied to a spray requirement wherein the injection nozzle provides an angle of spray of not greater than 50°.

3. The injection valve according to claim 1, wherein the valve-closure member has a portion thereof from the outer straight portion to a valve seat portion formed in a rounded surface or a spherical surface so as to tangentially merge in the outer straight portion.

4. A cylinder injection type fuel injection valve comprising:

a valve body formed in a hollow shape;

a valve seat provided in an end of the valve body and having an injection nozzle formed therein;

a valve-closure member provided in the valve body so as to be movable therein and to move away from and toward the valve seat for opening and closing the injection nozzle; and a swirler provided around the valve-closure member to slidably support the valve-closure member and give a swirling force to fuel to be sprayed through the injection nozzle, the swirler having grooves formed therein, and the respective grooves having a groove depth and groove outlets;

wherein the valve-closure member has an outer straight portion or an outer cylindrical portion confronting the respective groove outlets at a length of not less than 1/10 of the groove depth when the valve is fully opened.

5. The injection valve according to claim 4, which is applied to a spray requirement wherein the injection nozzle provides an angle of spray of not greater than 50°.

6. The injection valve according to claim 4, wherein the valve-closure member has a portion thereof from the outer straight portion to a valve seat portion formed in a rounded surface or a spherical surface so as to tangentially merge in the outer straight portion.

* * * * *